US009186888B2

(12) United States Patent
Kashimura

(10) Patent No.: US 9,186,888 B2
(45) Date of Patent: Nov. 17, 2015

(54) LIQUID DISCHARGING APPARATUS, CONTROL METHOD THEREOF, AND PROGRAM

(71) Applicant: Seiko Epson Corporation, Tokyo (JP)

(72) Inventor: Toru Kashimura, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/456,271

(22) Filed: Aug. 11, 2014

(65) Prior Publication Data

US 2015/0054868 A1 Feb. 26, 2015

(30) Foreign Application Priority Data

Aug. 20, 2013 (JP) ..... 2013-170584

(51) Int. Cl.

| | |
|---|---|
| ***B41J 29/38*** | (2006.01) |
| ***B41J 2/045*** | (2006.01) |
| ***B41J 2/14*** | (2006.01) |
| ***B41J 2/155*** | (2006.01) |

(52) U.S. Cl.

CPC ..... *B41J 2/04541* (2013.01); *B41J 2/0459* (2013.01); *B41J 2/04551* (2013.01); *B41J 2/04568* (2013.01); *B41J 2/04581* (2013.01); *B41J 2/04588* (2013.01); *B41J 2/04593* (2013.01); *B41J 2/14274* (2013.01); *B41J 2/155* (2013.01)

(58) Field of Classification Search

CPC ..... B41J 2/04568

See application file for complete search history.

(56) References Cited

U.S. PATENT DOCUMENTS

| | | | | |
|---|---|---|---|---|
| 5,132,702 | A * | 7/1992 | Shiozaki et al. | 347/12 |
| 8,382,224 | B2 | 2/2013 | Tabata et al. | |
| 8,632,148 | B2 | 1/2014 | Tabata et al. | |
| 2008/0018686 | A1 * | 1/2008 | Oshima et al. | 347/11 |
| 2009/0213152 | A1 * | 8/2009 | Tabata et al. | 347/10 |

FOREIGN PATENT DOCUMENTS

| | | | |
|---|---|---|---|
| JP | 2010-114711 | A | 5/2010 |
| JP | 2011-005733 | A | 1/2011 |
| JP | 2013-038458 | A | 2/2013 |

* cited by examiner

*Primary Examiner* — Shelby Fidler

(74) *Attorney, Agent, or Firm* — Harness, Dickey & Pierce, P.L.C.

(57) ABSTRACT

There is provided a liquid discharging apparatus including: an original drive signal generation unit which generates an original drive signal; a signal modulation unit which modulates the original drive signal to generate a modulation signal; a first signal amplifying unit which amplifies the modulation signal to generate a first amplified modulation signal; a second signal amplifying unit which amplifies the modulation signal to generate a second amplified modulation signal; an amplification control unit which controls operations of the first signal amplifying unit and the second signal amplifying unit; a signal conversion unit which converts the first amplified modulation signal and the second amplified modulation signal into a drive signal; a plurality of piezoelectric elements which is deformed by the drive signal; a plurality of cavities which expands or contracts in accordance with the deformation of the plurality of piezoelectric elements; a plurality of nozzles which communicates with each of cavities.

3 Claims, 11 Drawing Sheets

LIQUID DISCHARGING APPARATUS, CONTROL METHOD THEREOF, AND PROGRAM

The entire disclosure of Japanese Patent Application No. 2013-170584, filed Aug. 20, 2013 is expressly incorporated by reference herein.

BACKGROUND

1. Technical Field

The present invention relates to a liquid ejecting apparatus which ejects liquid by applying a drive signal to an actuator, a control method thereof, and a program, and is preferable for a liquid ejection type printing apparatus which is designed to print predetermined characters, images, and the like by ejecting minute liquid droplets from nozzles of a liquid ejecting head and forming fine particles (dots) on a print medium.

2. Related Art

As one example of liquid discharging apparatuses, an ink jet printer which discharges ink (liquid) from nozzles provided at a head to a recording medium has been known. Generally, a serial head scheme in which a nozzle array including multiple nozzles aligned in a predetermined direction is formed at a head and an image with a nozzle array width is printed by the head discharging ink while relatively moving in an intersecting direction between a scanning direction of the head and a transport direction of a recording medium, for example, a line head scheme in which nozzles are arranged in an array in a direction intersecting with a transport direction of a print medium and an image is printed when the print medium passes below the nozzles, and the like as disclosed in JP-A-2011-5733, and the like have been known.

Methods of ejecting liquid from nozzles of a liquid ejecting head include an electrostatic scheme, a piezoelectric scheme, and a film boiling liquid ejecting scheme. In a case of the piezoelectric scheme, for example, if a drive signal is applied to a piezoelectric element as an actuator, then a vibration plate in a cavity is displaced, pressure change occurs in the cavity, and liquid is ejected from nozzles by the pressure change. In a case of a serial head scheme high-speed printer in which liquid is ejected at a high speed by causing a liquid ejecting head to perform scanning at a high speed and driving a large number of piezoelectric elements in short time, and in a case of a line head scheme liquid ejection type printing apparatus or the like in which liquid is ejected at the same time from a plurality of nozzles by simultaneously driving a plurality of piezoelectric elements, it is necessary to drive a large number of piezoelectric elements, and burden applied on a drive circuit per unit time is significantly large. Therefore, it is generally difficult to generate the drive signal by using the same configuration as that of a serial head scheme ink jet printer in the related art, which has been provided in the consumer market, without any change.

Thus, a method of using a plurality of Digital-to-Analog Converters (DACs) and a plurality of amplifying circuits (hereinafter, also referred to as amplifiers) to generate a plurality of drive signals and equally dividing the number of nozzles to be supported by one drive signal can be considered. However, in a case of providing the plurality of DACs and amplifiers, errors of the respective DACs and errors of the respective amplifiers increase in a multiplied manner due to the combination thereof. If errors of the driven piezoelectric elements are further taken into consideration, errors as a whole further increase. As a result, it is difficult to perform overall control, and quality of a material produced by the liquid ejection type printing apparatus may deteriorate.

Here, it is preferable to generate the drive signal by using a single DAC and a single amplifier in order to minimize an influence of the errors. However, there is a limitation in power supply of the amplifier (for example, there is a limitation in allowable current of a circuit in an output stage). Therefore, it is not possible to appropriately drive a large number of piezoelectric elements and quality of the produced material deteriorates in the case of the piezoelectric scheme, for example, and therefore, such a configuration is not realistic.

SUMMARY

An advantage of some aspects of the invention is to provide a liquid discharging apparatus or the like which enables liquid ejection from a large number of nozzles included in a line head scheme liquid ejection type printing apparatus, for example, and suppresses degradation in quality of a produced material due to errors of DAC and the like.

(1) According to an aspect of the invention, there is provided a liquid discharging apparatus including: an original drive signal generation unit which generates an original drive signal; a signal modulation unit which modulates the original drive signal to generate a modulation signal; a first signal amplifying unit which amplifies the modulation signal to generate a first amplified modulation signal; a second signal amplifying unit which amplifies the modulation signal to generate a second amplified modulation signal; an amplification control unit which controls operations of the first signal amplifying unit and the second signal amplifying unit; a signal conversion unit which converts the first amplified modulation signal and the second amplified modulation signal into a drive signal; a first piezoelectric element which is deformed by the drive signal; a first cavity which expands or contracts in accordance with the deformation of the first piezoelectric element; a first nozzle which communicates with the first cavity and discharges liquid in accordance with an increase or a decrease in pressure in the first cavity; a second piezoelectric element which is deformed by the drive signal; a second cavity which expands or contracts in accordance with the deformation of the second piezoelectric element; and a second nozzle which communicates with the second cavity and discharges the liquid in accordance with an increase or a decrease in pressure in the second cavity.

According to the liquid discharging apparatus of the invention, it is possible to provide at least the first signal amplifying unit and the second signal amplifying unit and to use the common drive signal by the plurality of signal amplifying units. For this reason, it is possible to apply the same drive signal to the respective nozzles in the printer such as a line head printer as an example of the liquid discharging apparatus, in which multiple nozzles are driven at the same time, and to thereby suppress variations in discharge and to improve quality of a produced material (a printed material, for example). In addition, the original drive signal is an original signal of a drive signal for controlling the deformation of the piezoelectric elements, namely the signal before the modulation, which is used as a reference of a waveform. The original drive signal generation unit includes a DAC and a memory, for example, and generates the original drive signal by selecting data (original drive data) corresponding the original drive signal from the memory and outputting the selected data to the DAC. The modulation signal is a digital signal obtained by performing pulse modulation (pulse width modulation or pulse density modulation, for example) on the original drive signal, and the signal modulation unit is a modulation circuit which performs the pulse modulation. The signal amplifying unit is a digital power amplifying circuit which is provided with a half bridge output stage, and the amplified modulation signal is a modulation signal amplified by the signal amplifying unit. The drive signal is a signal obtained by smoothing the amplified modulation signal by the signal conversion unit and is applied to the piezoelectric elements. The signal conversion unit is a smoothing filter which is configured of a coil and a capacitor, for example.

(2) It is preferable that the signal conversion unit include a first signal conversion unit which converts the first amplified modulation signal into the drive signal, and a second signal conversion unit which converts the second amplified modulation signal into the drive signal.

According to the liquid discharging apparatus, it is possible to offset errors by a minus error (an error in a direction in which an amplification rate decreases) in the signal amplifying unit and a plus error (an error which acts in a direction opposite to that of the minus error) in the signal conversion unit by providing the signal amplifying unit and the signal conversion unit as a pair, to apply the same drive signal to the respective nozzles, and to thereby suppress variations in discharge and improve quality of a produced material (a printed material, for example).

(3) It is preferable that the drive signal include a first drive signal which is converted by the first signal conversion unit and a second drive signal which is converted by the second signal conversion unit, that the first drive signal be applied to the first piezoelectric element, and that the second drive signal be applied to the second piezoelectric element.

According to the liquid discharging apparatus, it is possible to control the plurality of signal amplifying units in accordance with the operation modes such as print modes in the liquid discharging apparatus such as a printer by applying the first drive signal to the first piezoelectric element and applying the second drive signal to the second piezoelectric element. For example, it is assumed that the first piezoelectric element is used for discharging black ink and the second piezoelectric element is used for discharging color (cyan, magenta, or yellow, for example) ink. If the print mode of the printer is a monochrome print mode at this time, it is possible to perform control for amplifying only the first drive signal without amplifying the second drive signal which is used only for the color printing.

(4) It is preferable that the amplification control unit cause the first signal amplifying unit to generate the first amplified modulation signal and cause the second signal amplifying unit to generate the second amplified modulation signal in a first operation mode in which liquid is discharged from the first nozzle and the second nozzle, and cause the first signal amplifying unit to generate the first amplified modulation signal without causing the second signal amplifying unit to generate the second amplified modulation signal in a second operation mode in which the liquid is ejected from the first nozzle and is not ejected from the second nozzle.

According to the liquid discharging apparatus, it is possible to improve a power saving property by controlling the signal amplifying unit so as not to amplify the signal for the piezoelectric element which is not used (the piezoelectric element for discharging the liquid from the second nozzle in the second operation mode) depending on a print mode, a type of an image, or the like. For example, when the print mode of the printer is a monochrome print mode in the above example, it is possible to improve the power saving property by determining the second operation mode and not causing the second signal amplifying unit to generate the second amplified modulation signal. In addition, it is possible to improve the power saving property by not causing the second signal amplifying unit to generate the second amplified modulation signal in a case where the amplification control unit determines the second operation mode, and the liquid is not discharged from the second nozzle, based on the image to be printed.

(5) It is preferable that the liquid discharging apparatus further include: a third piezoelectric element which is deformed by the first drive signal; a third cavity which expands or contracts in accordance with the deformation of the third piezoelectric element; and a third nozzle which communicates with the third cavity and discharges the liquid in accordance with an increase or a decrease in pressure in the third cavity, that the first drive signal be applied to the third piezoelectric element, that the first nozzle be provided at one end of a nozzle array, that the third nozzle be provided at the other end of the nozzle array, and that the second nozzle be provided at the center of the nozzle array.

According to the liquid discharging apparatus, it is possible to separately operate the nozzles which are required to perform a special operation in case of flight deflection occurring and the nozzles are used in a case where such a problem does not occur and to improve quality of a produced material.

Here, the flight deflection means a phenomenon where ink droplets discharged from the nozzles do not fly along ideal paths and deviate from ideal output positions (also referred to as landing positions). Since one-pass printing is performed in the line head printer, in particular, a result of printing is significantly degraded only by the occurrence of a failure in ink discharge by a single nozzle among the multiple nozzles.

The usage rates of the nozzles positioned at the ends are lower than that of the nozzle at the center due to the problem of the flight deflection. It is possible to perform more efficient allocation by dividing the number of nozzles to be supported based on recording rates (ink amounts per unit area), for example, without simply dividing the number of nozzles to be supported by the number of amplifiers (equally dividing the number of nozzles to be supported, for example).

(6) It is preferable that the amplification control unit cause the first signal amplifying unit to generate the first amplified modulation signal without causing the second signal amplifying unit to generate the second amplified modulation signal when the nozzles, a number of which is less than a predetermined threshold value, are driven, and cause the first signal amplifying unit to generate the first amplified modulation signal and cause the second signal amplifying unit to generate the second amplified modulation signal when the nozzles, a number of which is equal to or greater than the threshold value, are driven.

According to the liquid discharging apparatus, the second signal amplifying unit is caused to generate the second amplified modulation signal when the number of nozzles to be driven (the nozzles for which the drive signals are applied to the piezoelectric elements for discharging the liquid) is equal to or greater than the predetermined threshold value. For this reason, the second signal amplifying unit is not used when not necessary, and therefore, it is possible to improve the power saving property.

(7) According to another aspect of the invention, there is provided a control method for a liquid discharging apparatus including an original drive signal generation unit which generates an original drive signal, a signal modulation unit which modulates the original drive signal to generate a modulation signal; a first signal amplifying unit which amplifies the modulation signal to generate a first amplified modulation signal; a second signal amplifying unit which amplifies the modulation signal to generate a second amplified modulation signal; a signal conversion unit which converts the first amplified modulation signal and the second amplified modulation signal into a drive signal, and a plurality of nozzles which discharges liquid based on the drive signal, the method including: acquiring a number of the nozzles to be driven; and causing the first signal amplifying unit to generate the first amplified modulation signal without causing the second signal amplifying unit to generate the second amplified modulation signal when the nozzles, a number of which is less than a predetermined threshold value, are driven; or causing the first signal amplifying unit to generate the first amplified modulation signal and causing the second signal amplifying unit to generate the second amplified modulation signal when the nozzles, a number of which is equal to or greater than the predetermined value, are driven.

(8) According to still another aspect of the invention, there is provided a program used for a liquid discharging apparatus including an original drive signal generation unit which generates an original drive signal, a signal modulation unit which modulates the original drive signal to generate a modulation signal; a first signal amplifying unit which amplifies the modulation signal to generate a first amplified modulation signal; a second signal amplifying unit which amplifies the modulation signal to generate a second amplified modulation signal; a signal conversion unit which converts the first amplified modulation signal and the second amplified modulation signal into a drive signal, and a plurality of nozzles which discharges liquid based on the drive signal, the program causing a computer to execute: acquiring a number of the nozzles to be driven; and causing the first signal amplifying unit to generate the first amplified modulation signal without causing the second signal amplifying unit to generate the second amplified modulation signal when the nozzles, a number of which is less than a predetermined threshold value, are driven; or causing the first signal amplifying unit to generate the first amplified modulation signal and causing the second signal amplifying unit to generate the second amplified modulation signal when the nozzles, a number of which is equal to or greater than the predetermined value, are driven.

According to the control method and the program of the present invention, the second signal amplifying unit is caused to generate the second amplified modulation signal when the number of nozzles to be driven is equal to or greater than the threshold value. For this reason, the second signal amplifying unit is not used when not necessary, and therefore, it is possible to improve the power saving property of the liquid discharging apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. First Embodiment

Description will be given of an application of a liquid ejecting apparatus according to an embodiment of the invention to a liquid ejection type printing apparatus.

1.1 Configuration of Print System

Figure 1:
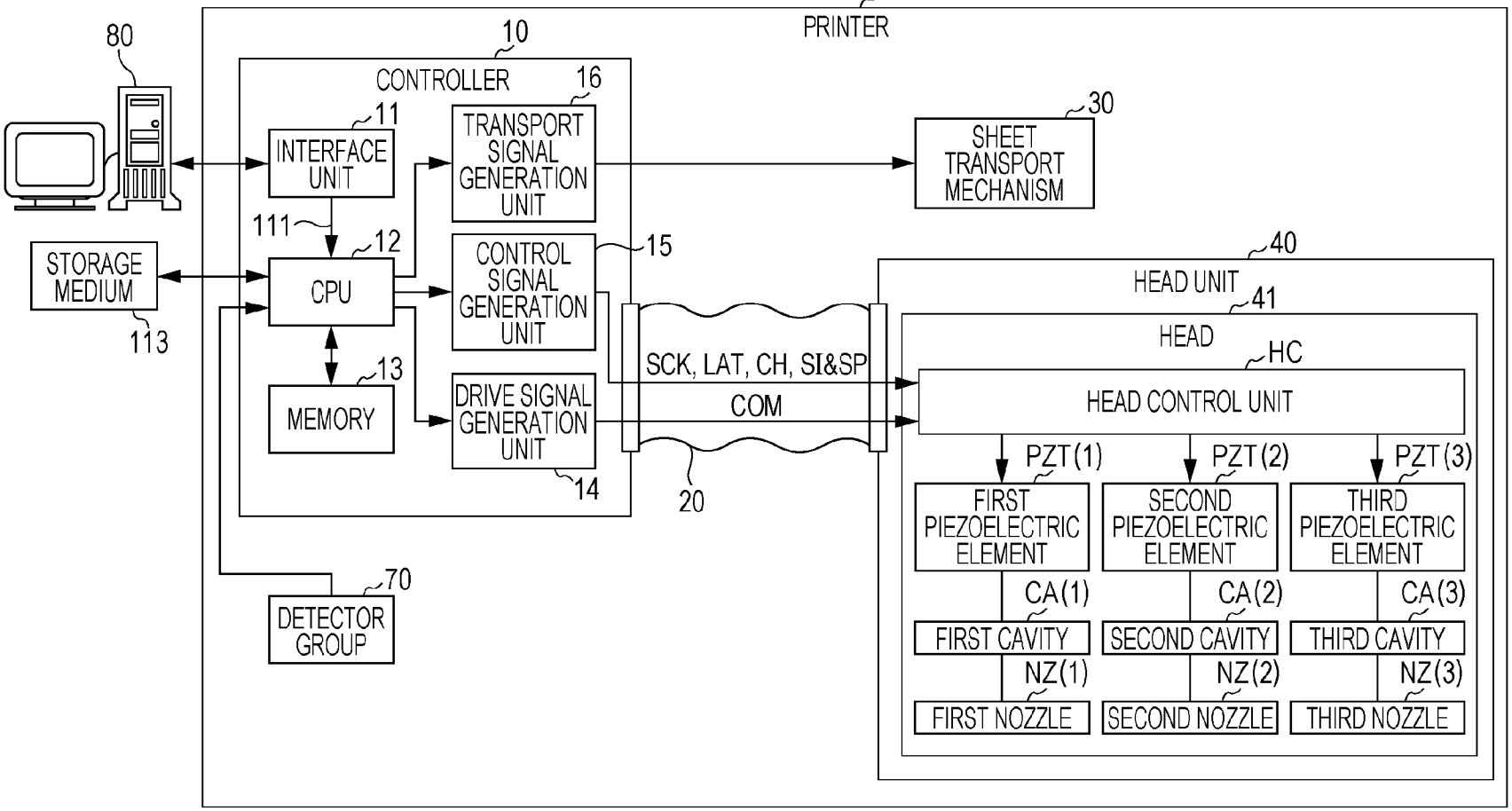
FIG. 1 is a block diagram showing an overall configuration of a print system.

FIG. 1 is a block diagram showing an overall configuration of a print system which includes the liquid ejection type printing apparatus (printer 1) according to the first embodiment. The printer 1 is a line head printer by which a sheet S (see FIGS. 2 and 3) is transported in a predetermined direction and printing is performed in a print area during the course of the transport, as will be described later.

The printer 1 is connected to a computer 80 so as to be able to communicate therewith, and a printer drive installed in the computer 80 creates print data including an image to be printed by the printer 1 and outputs the print data to the printer 1. The printer 1 includes a controller 10, a sheet transport mechanism 30, a head unit 40, and a detector group 70. Although the printer 1 may include a plurality of head units 40 as will be described later, a representative head unit 40 will be shown in FIG. 1 and described.

The controller 10 in the printer 1 is for performing overall control in the printer 1. An interface unit 11 transmits and receives data to and from a computer as an external apparatus. In addition, the interface unit 11 outputs print data 111 in the data received from the computer 80 to the CPU 12. The print data 111 includes image data and data for designating a printing mode, for example.

A CPU 12 is a computation device for performing overall control in the printer 1 and controls the head unit 40 and the sheet transport mechanism 30 via a drive signal generation unit 14, a control signal generation unit 15, and a transport signal generation unit 16. A memory 13 is for securing a region for storing programs of the CPU 12 and data, an operation region, and the like. Conditions in the printer 1 are monitored by the detector group 70, and the controller 10 performs control based on a detection result from the detector group 70. In addition, the program of the CPU 12 and the data may be stored on a storage medium 113. Although the storage medium 113 may be one of a magnetic disc such as a hard disk, an optical disc such as a DVD, and a non-volatile memory such as a flash memory, the storage medium is not particularly limited thereto. As shown in FIG. 1, the CPU 12 may be able to access the storage medium 113 which is connected to the printer 1. In addition, the storage medium 113 may be connected to the computer 80, and the CPU 12 may be able to access (the route is not shown in the drawing) the storage medium 113 via the interface unit 11 and the computer 80.

The drive signal generation unit 14 generates a drive signal COM for displacing piezoelectric elements PZT included in the head 41. The drive signal generation unit 14 includes a part of an original drive signal generation unit 25, a signal modulation unit 26, a signal amplifying unit 28 (digital power amplifying circuit), and a signal conversion unit 29 (smoothing filter) as will be described later (see FIG. 7). The drive signal generation unit 14 causes the original drive signal generation unit 25 to generate an original drive signal 125, causes the signal modulation unit 26 to perform pulse modulation on the original drive signal 125 to generate a modulation signal 126, causes the signal amplifying unit 28 to amplify the modulation signal 126, and causes the signal conversion unit 29 to smooth an amplified modulation signal 128 (which is acquired by amplifying the modulation signal 126) to generate the drive signal COM in response to an instruction from the CPU 12.

The control signal generation unit 15 generates a control signal in response to an instruction from the CPU 12. The control signal is a signal used for controlling the head 41 to select a nozzle for ejection, for example. According to this embodiment, the control signal generation unit 15 generates a clock signal SCK, a latch signal LAT, a channel signal CH, and a control signal including drive pulse selection data SI and SP, and details of these signals will be described later. In addition, the control signal generation unit 15 may be configured to be included in the CPU 12 (that is, the CPU 12 may be configured to also function as the control signal generation unit 15).

Here, the drive signal COM generated by the drive signal generation unit 14 is an analog signal, voltage of which successively changes, and the clock signal SCK, the latch signal LAT, the channel signal CH, and the drive pulse selection data SI and SP as control signals are digital signals. The drive signal COM and the control signals are transmitted to the head 41 in the head unit 40 via a cable 20 as a flexible flat cable (hereinafter, also referred to as an FFC). In relation to the control signals, a plurality of signals may be transmitted in a time division manner by using a differential serial scheme. At this time, it is possible to reduce the number of required transmission lines as compared with a case of parallel transmission of the control signals for each type, to avoid degradation in a sliding property due to overlapping of multiple FFCs, and to reduce the size of connecters provided at the controller 10 and the head unit 40.

The transport signal generation unit 16 generates a signal for controlling the sheet transport mechanism 30 in response to an instruction from the CPU 12. The sheet transport mechanism 30 supports the continuous sheet S which is wound in a rolled manner such that the sheet S can be rotated, and transports the sheet S by being rotated such that predetermined characters, images, and the like are printed in a print area. For example, the sheet transport mechanism 30 transports the sheet S in a predetermined direction based on the signal generated by the transport signal generation unit 16. In addition, the transport signal generation unit 16 may be configured to be included in the CPU 12 (that is, the CPU 12 may be configured to also function as the transport signal generation unit 16).

The head unit 40 includes the head 41 as a liquid ejecting unit. Although only one head 41 is shown in FIG. 1 due to a space in the paper, the head unit 40 according to this embodiment includes a plurality of heads 41. Each head 41 includes at least two actuator units which are provided with a piezoelectric element PZT, a cavity CA, and a nozzle NZ, and includes a head control unit HC for controlling displacement of the piezoelectric element PZT. The actuator unit includes the piezoelectric element PZT which can be displaced by the drive signal COM, the cavity CA, which is filled with liquid, in which pressure increases and decreases in accordance with the displacement of the piezoelectric element PZT, and the nozzle NZ which communicates with the cavity CA and discharges the liquid as liquid droplets by the increase and the decrease in the pressure in the cavity CA. The head control unit HC controls the displacement of the piezoelectric element PZT based on the drive signal COM and the control signal from the controller 10.

Hereinafter, numbers in parentheses will be added to reference numerals for distinguishing elements included in the respective actuator units. Three actuator units are shown in the example in FIG. 1, the first actuator unit includes the first piezoelectric element PZT(1), the first cavity CA(1), and the first nozzle NZ(1), the second actuator unit includes the second piezoelectric element PZT(2), the second cavity unit CA(2), and the second nozzle NZ(2), and the third actuator unit includes the third piezoelectric element PZT(3), the third cavity CA(3), and the third nozzle NZ(3). In addition, the number of the actuator units is not limited to three and may be two, four or more, for example. Although the first to third actuator units are included in the single head 41 in FIG. 1 for convenience of illustration, a part thereof may be included in another head 41 which is not shown in the drawing.

The drive signal COM is generated by the drive signal generation unit 14 as shown in FIG. 1 and transmitted to the first piezoelectric element PZT(1), the second piezoelectric element PZT(2), and the third piezoelectric element PZT(3) via the cable 20 and the head control unit HC. In addition, the control signals including the clock signal SCK, the latch signal LAT, the channel signal CH, and the drive pulse selection data SI and SP are generated by the control signal generation unit 15 as shown in FIG. 1 and used for the control of the head control unit HC via the cable 20.

1.2 Configuration of Printer

Figure 2:
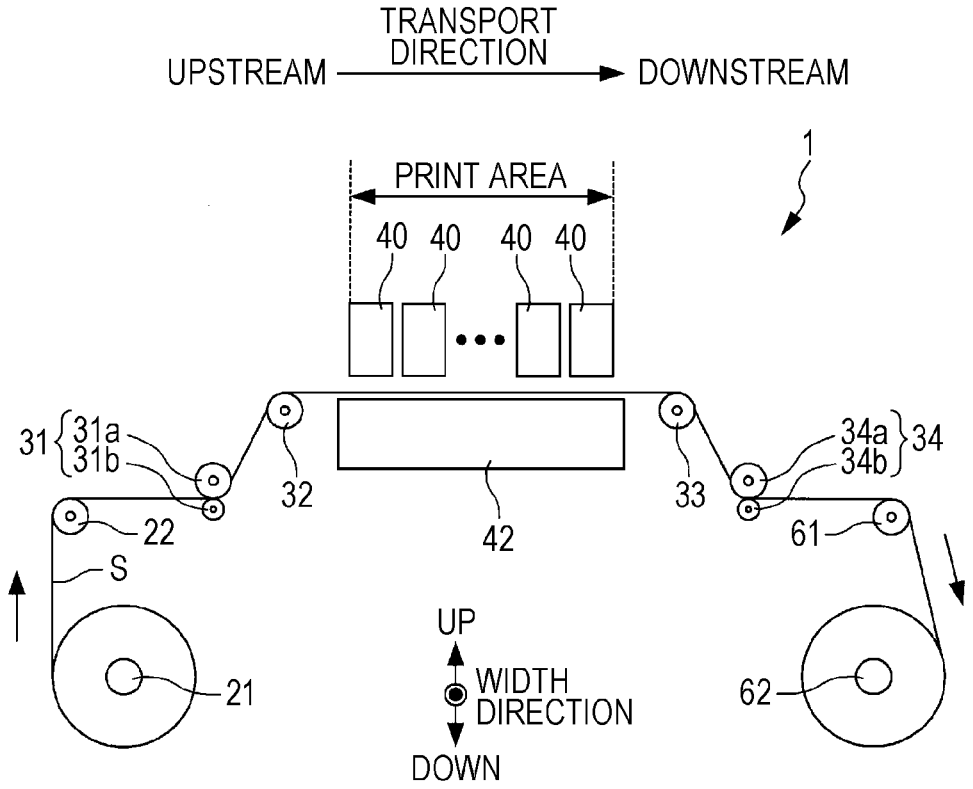
FIG. 2 is a schematic cross-sectional view of a printer.

FIG. 2 is a schematic cross-sectional view of the printer 1. Although description will be given on the assumption that the sheet S is a continuous sheet which is wound in the rolled manner in the example in FIG. 2, the recording medium on which the printer 1 prints an image is not limited to the continuous sheet and may be a cut paper, a cloth, a film, or the like.

The printer 1 includes a winding shaft 21 for feeding the sheet S by being rotated and a relay roller 22, around which the sheet S fed by the winding shaft 21 is wound, which guides the sheet S to an upstream transport roller pair 31. In addition, the printer 1 includes a plurality of relay rollers 32 and 33, around which the sheet S is wound, which send the sheet, the upstream transport roller pair 31 which is disposed on a further upstream side in the transport direction than the print area, and a downstream transport roller pair 34 which is disposed on a further downstream side in the transport direction than the print area. The upstream transport roller pair 31 and the downstream transport roller pair 34 respectively include driving rollers 31*a* and 34*a* which are connected to a motor (not shown) and rotate for driving and driven rollers 31*b* and 34*b* which are rotated in accordance with rotation of the driving rollers 31*a* and 34*a*. In addition, transport force is applied to the sheet S by rotating the driving rollers 31*a* and 34*a* for the driving in a state where the upstream transport roller pair 31 and the downstream transport roller pair 34 respectively pinch the sheet S. The printer 1 includes a relay roller 61, around which the sheet S sent from the downstream transport roller pair 34 is wound, which sends the sheet S, and a winding drive shaft 62 around which the sheet S sent from the relay roller 61 is wound. The sheet S after the printing is sequentially wound in the rolled manner in accordance with the rotation for the driving of the winding drive shaft 62. These rollers and the motor, which is not shown in the drawing, correspond to the sheet transport mechanism 30 in FIG. 1.

The printer 1 includes the head unit 40 and a platen 42 which supports the sheet S in the print area from a surface opposite to the printing surface thereof. The printer 1 may be provided with a plurality of head units 40. The head units 40 may be prepared for the respective ink colors, for example, and the printer 1 may be configured such that four head units 40 capable of discharging four-color ink, namely yellow (Y) ink, magenta (M) ink, cyan (C) ink, and black (K) ink are aligned in the transport direction. Although a single representative head unit 40 will be explained in the following description, color printing can be performed by allocating the ink colors to the respective nozzles.

Figure 3:
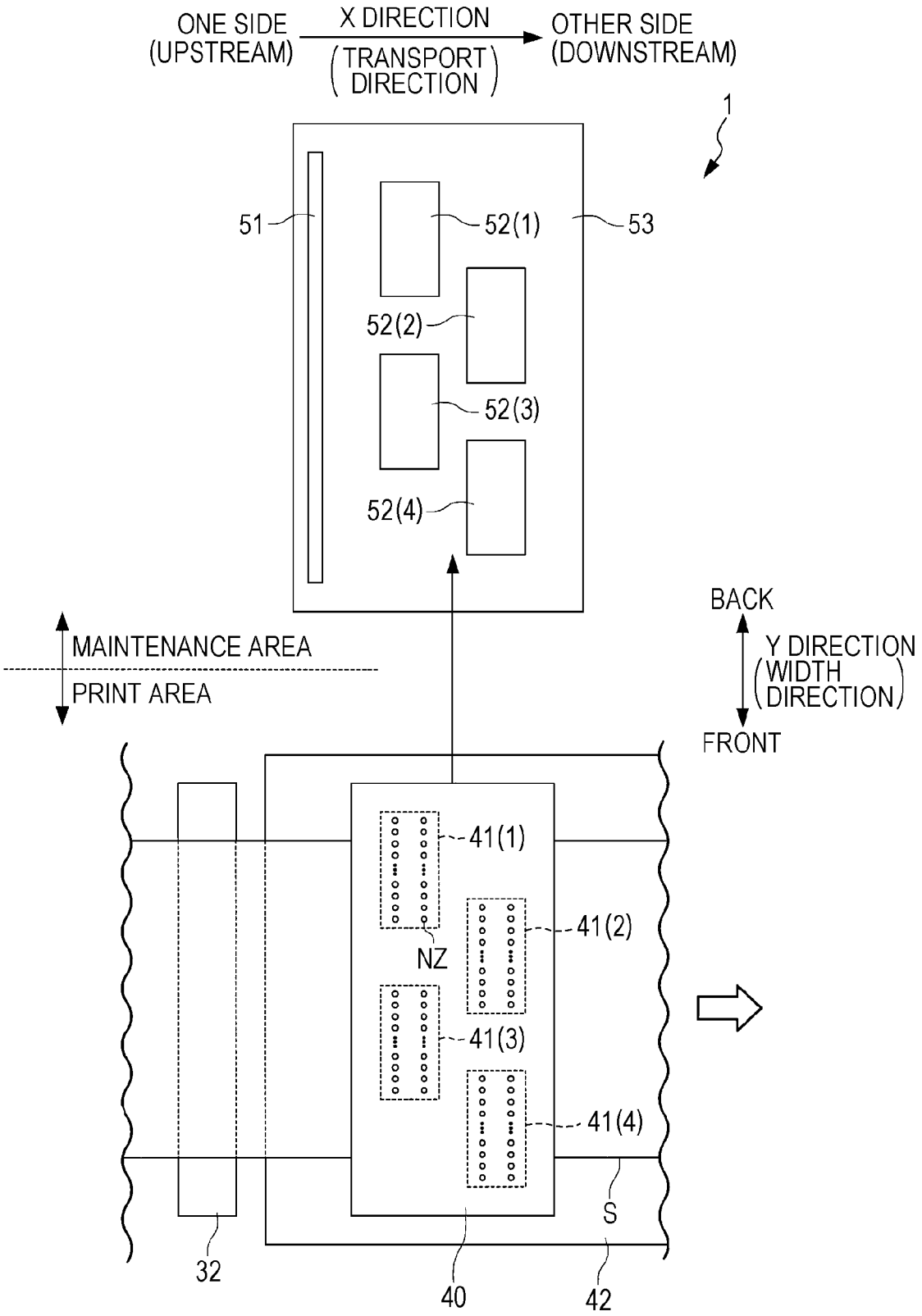
FIG. 3 is a schematic top view of the printer.

As shown in FIG. 3, a plurality of heads 41(1) to 41(4) are aligned in a width direction (Y direction) of the sheet S, which intersects with the transport direction of the sheet S, in the head unit 40. Smaller numbers are applied in an order from the furthest head 41 in the Y direction for explanation. In addition, multiple nozzles NZ for discharging the ink are aligned in the Y direction at predetermined intervals on the surfaces (lower surfaces), which face the sheet S, of the respective heads 41. In FIG. 3, positions of the head 41 and the nozzle NZ when the head unit 40 is viewed from the upper side will be virtually shown. Positions of nozzles NZ at ends of heads 41 which are adjacent to each other in the Y direction (41(1) and 41(2), for example) are at least partially overlapped, and the nozzles NZ are aligned in the Y direction at the predetermined intervals over a length which is equal to or greater than the width of the sheet S on the lower surface of the head unit 40. Therefore, a two-dimensional image is printed on the sheet S by the head unit 40 discharging the ink from the nozzles NZ onto the sheet S which is transported below the head unit 40 without stopping.

Although the number of heads 41 belonging to the head unit 40 is four in FIG. 3 due to a space on the paper, the number of heads 41 is not limited thereto. That is, the number of the heads 41 may be greater than or less than four. Although the heads 41 in FIG. 3 are arranged in a zigzag manner, the arrangement is not limited thereto. Here, although an ink discharging scheme from the nozzles NZ is the piezoelectric scheme according to which the ink is discharged by applying voltage to the piezoelectric elements PZT and causing an ink chamber to expand and contract in this embodiment, a thermal scheme according to which air bubbles are generated in the nozzles NZ by using a heat generating element and the ink is discharged by the air bubbles may also be employed.

Although the sheet S is supported by a horizontal surface of the platen 42 in this embodiment, the invention is not limited thereto, a configuration is also applicable in which a rotation drum rotating around the width direction of the sheet S as a rotation shaft is employed as the platen 42 and the ink is discharged from the head 41 while the sheet S is wound around the rotation drum and transported. In such a case, the head unit 40 is arranged in an inclined manner along an arc outer circumferential surface of the rotation drum. In addition, when the ink discharged from the head 41 is UV ink which is cured by ultraviolet irradiation, an irradiator for irradiating the ink with an ultraviolet ray may be provided on the downstream side of the head unit 40.

Here, the printer 1 is provided with a maintenance area for cleaning the head unit 40. In the maintenance area of the printer 1, a wiper 51, a plurality of caps 52, and an ink receiving unit 53 are present. The maintenance area is located at a further side in the Y direction as compared with the platen 42 (that is, the print area), and the head unit 40 moves to the further side in the Y direction during the cleaning.

The wiper 51 and the caps 52 are supported by the ink receiving unit 53 and are capable of moving in the X direction (the transport direction of the sheet S) by the ink receiving unit 53. The wiper 51 is a plate-shaped member which is provided so as stand from the ink receiving unit 53 and is formed by an elastic member, cloth, felt, or the like. The caps 52 are rectangular parallelepiped members formed by elastic members or the like and are provided for each head 41. In addition, the caps 52(1) to 52(4) are also aligned in the width direction in accordance with the arrangement of the heads 41(1) to 41(4) in the head unit 40. Therefore, the heads 41 and the caps 52 face each other when the head unit 40 moves to the further side in the Y direction, and the caps 52 are brought into tight contact with nozzle opening surfaces of the heads 41 so as to be able to seal the nozzles NZ when the head unit 40 is lowered (or the caps 52 are lifted). The ink receiving unit 53 also functions to receive the ink discharged from the nozzles NZ during the cleaning of the head 41.

When the ink is discharged from the nozzles NZ provided at the heads 41, minute ink droplets are generated along with main ink droplets, drifting as mist, and adheres the nozzle opening surfaces of the heads 41. In addition, not only ink but also dust, paper dust, and the like also adhere the nozzle opening surfaces of the heads 41. If such foreign matter is left and accumulated in the state of adhering to the nozzle opening surfaces of the heads 41, the nozzles NZ are blocked, and ink discharge from the nozzles NZ is inhibited. Thus, a wiping process is periodically performed for cleaning the head unit 40 in the printer 1 according to this embodiment.

1.3 Drive Signal and Control Signals

Hereinafter, detailed description will be given of the drive signal COM and the control signals from the controller 10, which are transmitted via the cable 20. First, a structure of each head 41 will be described, waveforms of the drive signal COM and the control signals will be exemplified, and a structure of the head control unit HC will be then described.

1.3.1 Structure of Head

Figure 4:
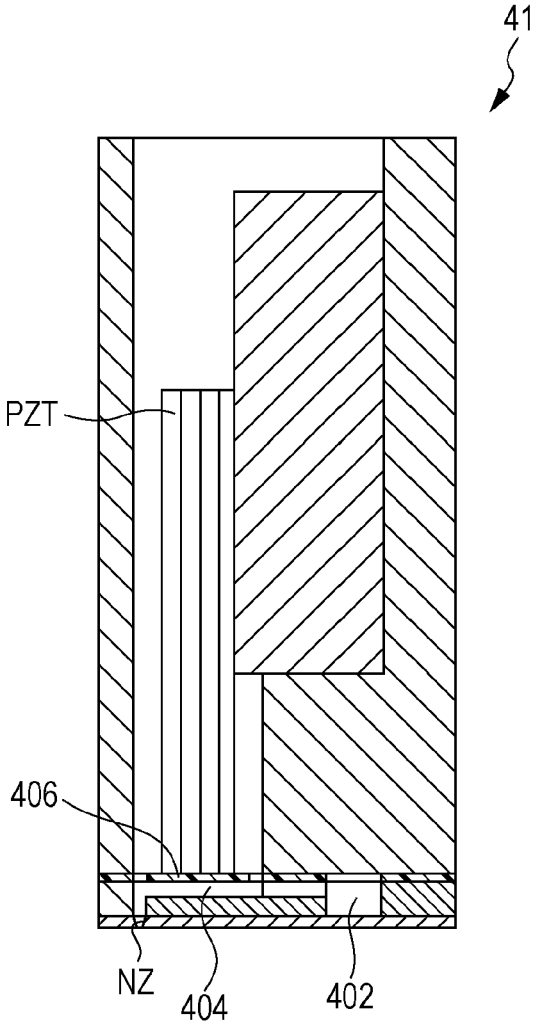
FIG. 4 is a diagram illustrating a structure of a head.

FIG. 4 is a diagram illustrating a structure of the head 41. In FIG. 4, the nozzle NZ, the piezoelectric element PZT, an ink supply path 402, a nozzle communicating path 404, and an elastic plate 406 are shown. The ink supply path 402 and the nozzle communicating path 404 correspond to the cavity CA.

To the ink supply path 402, ink droplets are supplied from an ink tank which is not shown in the drawing. In addition, the ink droplets are supplied to the nozzle communicating path 404. A drive pulse PCOM of the drive signal COM is applied to the piezoelectric elements PZT. If the drive pulse PCOM is applied, the piezoelectric elements PZT expand or contract (are displaced) in accordance with a waveform and cause the elastic plate 406 to vibrate. Then, the ink droplets are discharged from the nozzle NZ in an amount corresponding to amplitude of the drive pulse PCOM. Such actuator units configured by the nozzles NZ, the piezoelectric elements PZT, and the like are aligned as shown in FIG. 3 and configure the head 41 including a nozzle array.

1.3.2 Waveforms of Signals

Figure 5:
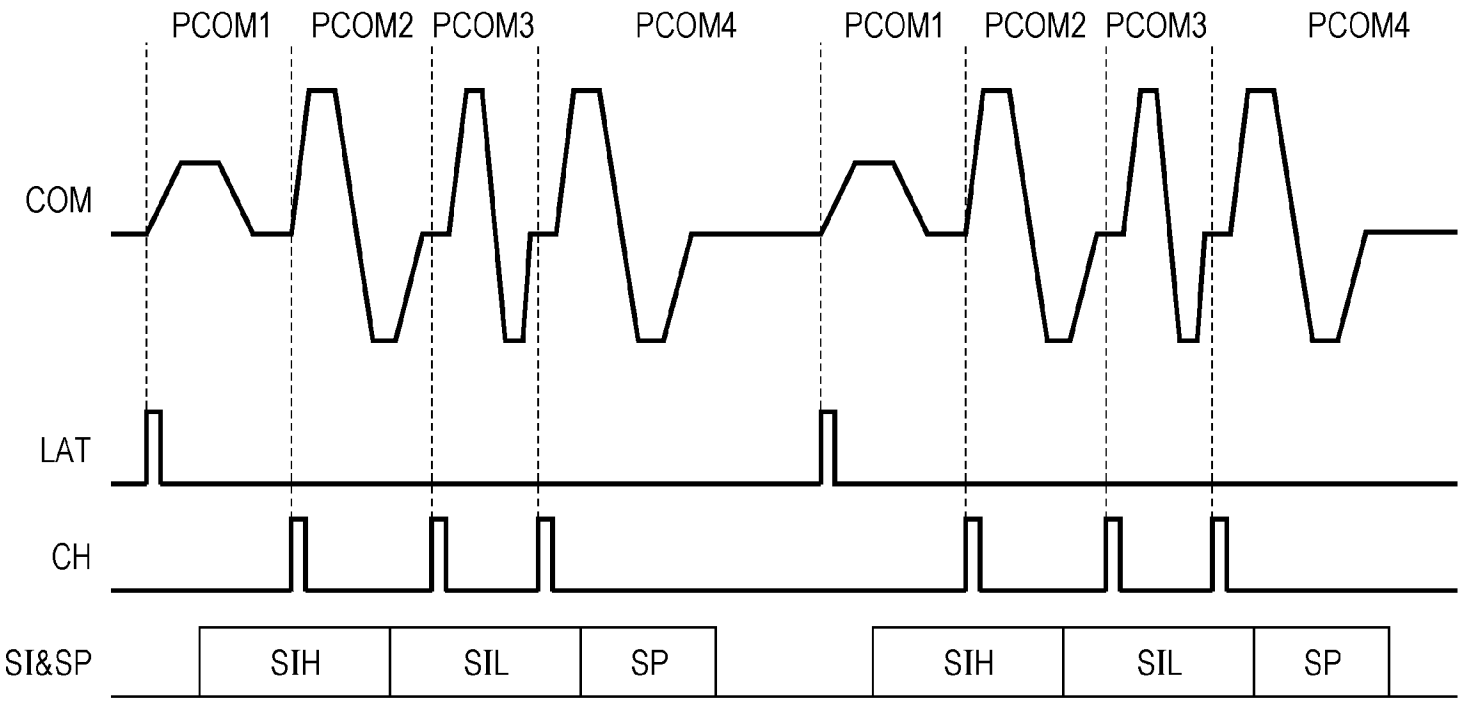
FIG. 5 is a diagram illustrating a drive signal from a drive signal generation unit and a control signal used for dot formation.

FIG. 5 is a diagram illustrating the drive signal COM from the drive signal generation unit 14 and the control signals used for dot formation. The drive signal COM is acquired by connecting, in a time series manner, the drive pulse PCOM as a unit drive signal for being applied to the piezoelectric elements PZT to eject the liquid, a rising part of the drive pulse PCOM corresponds to a stage where the volume in the cavity CA communicating with the nozzle is expanded to draw the liquid therein, a falling part of the drive pulse PCOM corresponds to a stage where the volume in the cavity CA is made to contract to press the liquid to the outside, and as a result of pressing the liquid to the outside, the liquid is ejected from the nozzle.

By changing voltage increase/decrease inclination and a crest value of the drive pulse PCOM configured of such a voltage trapezoidal wave in various manners, it is possible to change a drawing amount, a drawing speed, a pressing amount, and a pressing speed of the liquid and to thereby acquire dots with different sizes by changing the liquid ejection amount. Accordingly, it is possible to acquire dots with different sizes even in a case where a plurality of drive pulses PCOM are coupled in the time series manner, by selecting a single drive pulse PCOM among the plurality of drive pulses PCOM, applying the selected drive pulse PCOM to the piezoelectric element PZT, and ejecting the liquid or by selecting a plurality of drive pulses PCOM, applying the plurality of selected drive pulses PCOM to the piezoelectric elements PZT, and ejecting the liquid a plurality of times. That is, if a plurality of liquid droplets are landed on the same positions before the liquid droplets dry, substantially the same dot as that which is acquired by ejecting a large droplet is ejected can be acquired, and it is possible to increase the size of the dot. Combinations of such technologies enable multiple gradations. In addition, the drive pulse PCOM1 at the left end in FIG. 5 only draws the liquid and does not press the liquid to the outside unlike the drive pulses PCOM2 to PCOM4. This is called fine vibration and is used to suppress and prevent an increase viscosity of the liquid in the nozzles without ejecting the liquid.

To the head control unit HC, the clock signal SCK, the latch signal LAT, the channel signal CH, and the drive pulse selection data SI and SP as the control signals from the control signal generation unit 15 are input as well as the drive signal COM from the drive signal generation unit 14. Among these signals, the latch signal LAT and the channel signal CH are control signals for setting timing of the drive signal COM, and an output of a series of drive signals COM is started by the latch signal LAT, and the drive pulse PCOM is output for each channel signal CH as shown in FIG. 5. The drive pulse selection data SI and SP include pixel data SI (SIH and SIL) for designating a piezoelectric element PZT corresponding to a nozzle to be controlled to eject an ink droplet and a waveform pattern data SP of the drive signal COM. SIH and SIL correspond to an upper-order bit and a lower-order bit of the 2-bit pixel data SI, respectively.

1.3.3 Head Control Unit

Figure 6:
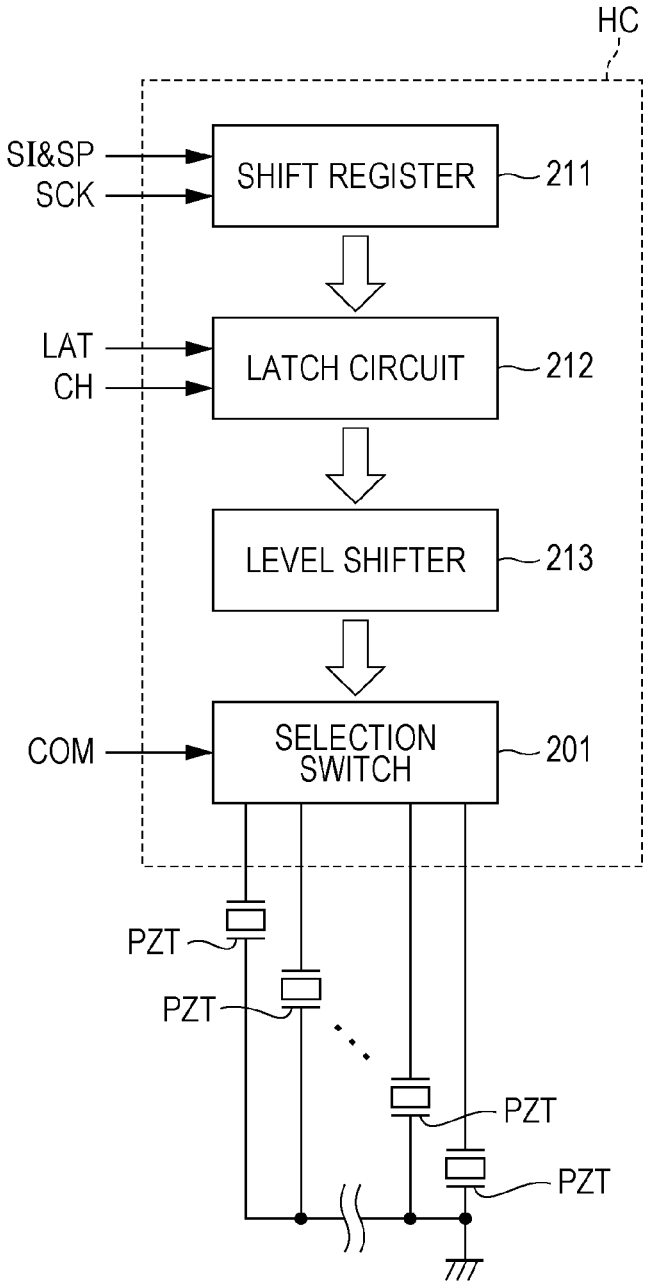
FIG. 6 is a block diagram illustrating a configuration of a head control unit.

FIG. 6 is a block diagram illustrating a configuration of the head control unit HC. The head control unit HC is provided with a shift register 211 which saves the drive pulse selection data SI and SP for designating the piezoelectric element PZT corresponding to the nozzle to be controlled to eject the liquid, a latch circuit 212 which temporarily saves the data in the shift register 211, and a level shifter 213 which applies the voltage of the drive signal COM to the piezoelectric element PZT by performing level conversion on the output from the latch circuit 212 and supplying the level-converted output to a selection switch 201.

The drive pulse selection data SI and SP is sequentially input to the shift register 211, and storage regions in the shift register 211 are sequentially shifted from the initial stage to the later stage in accordance with an input pulse of the clock signal SCK. The latch circuit 212 latches the respective output signals from the shift register 211 by the input latch signal LAT after the drive pulse selection data SI and SP corresponding to the number of nozzles is stored on the shift register 211. The signal saved in the latch circuit 212 is converted to have a voltage level, in which the selection switch 201 in the next stage can be turned on and off, by the level shifter 213. This is because the drive signal COM has a higher voltage than the output voltage of the latch circuit 212 and an operating voltage range of the selection switch 201 is set to be high in accordance with the high voltage. Therefore, the piezoelectric element PZT for which the selection switch 201 is closed by the level shifter 213 is connected to the drive signal COM (drive pulse PCOM) at connection timing of the drive pulse selection data SI and SP.

After the drive pulse selection data SI and SP of the shift register 211 is saved in the latch circuit 212, the next print information is input to the shift register 211, and the data saved in the latch circuit 212 is sequentially updated in accordance with liquid ejection timing. Even after the piezoelectric element PZT is disconnected from the drive signal COM (drive pulse PCOM) by the selection switch 201, the input voltage of the piezoelectric element PZT is maintained at a voltage immediately before the disconnection.

1.3.4 Drive Signal

Figure 7:
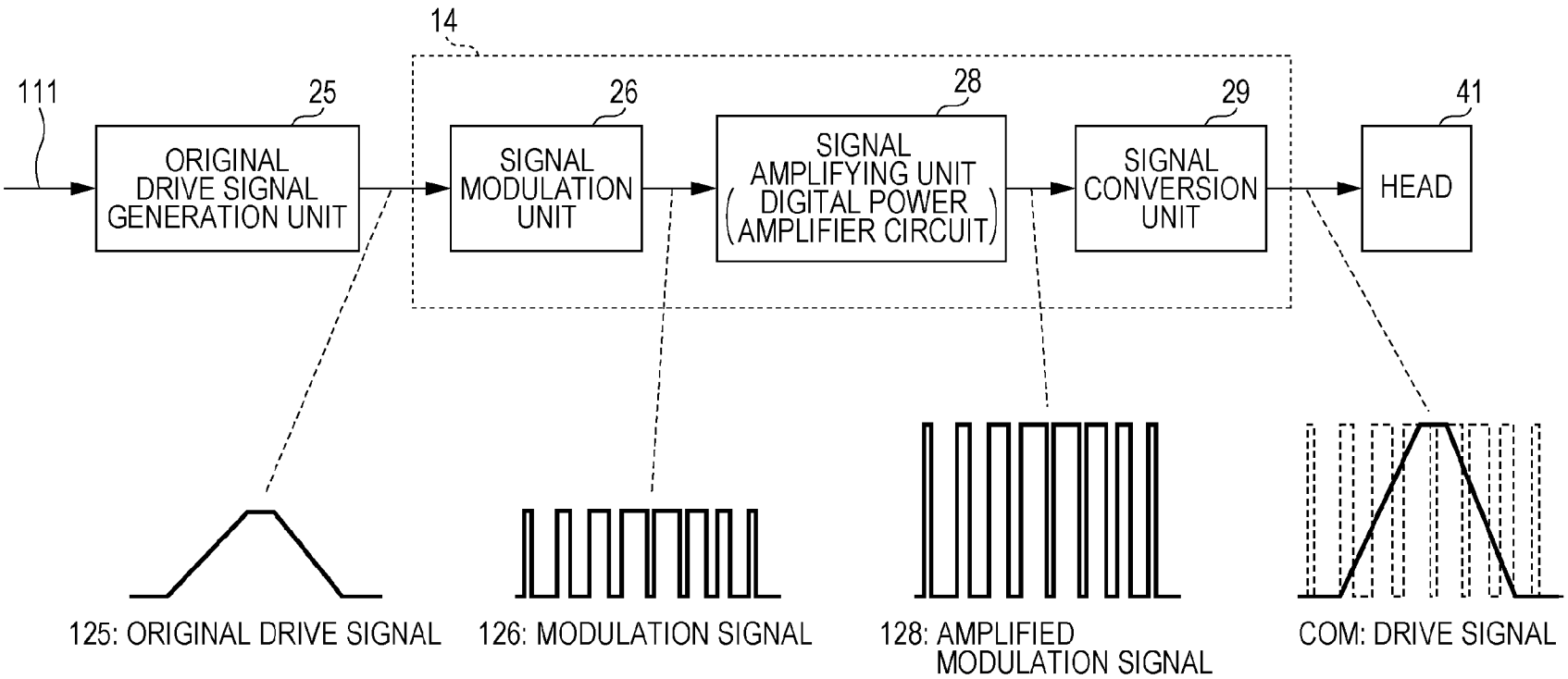
FIG. 7 is a diagram illustrating a flow for generating the drive signal.

FIG. 7 is a diagram illustrating a flow for generating the drive signal COM. As described above, a part of the original drive signal generation unit 25, the signal modulation unit 26, the signal amplifying unit 28 (digital power amplifying circuit), and the signal conversion unit 29 (smoothing filter) in FIG. 7 correspond to the drive signal generation unit 14. The original drive signal generation unit 25 generates the original drive signal 125 as shown in FIG. 7, for example, based on the print data 111 from the interface unit 11.

The original drive signal generation unit 25 includes the CPU 12, a DAC 39, and the like as will be described later and generates the original drive signal 125 by the CPU 12 selecting original drive data based on the print data 111 and outputting the selected original drive data to the DAC 39.

The signal modulation unit 26 receives the original drive signal 125 from the original drive signal generation unit 25, performs predetermined modulation thereon, and generates the modulation signal 126. Although the predetermined modulation is pulse width modulation (PWM) in this embodiment, another modulation scheme such as a Pulse-Density Modulation (PDM) may be used.

The signal amplifying unit 28 receives the modulation signal 126 and performs power amplification thereon. The signal conversion unit 29 smooths the amplified modulation signal 128 and generates the analog drive signal COM in which a voltage value at a part modulated to have a wide pulse width is high and a voltage value at a part modulated to have a narrow pulse width is low.

1.4 Configuration of Signal Amplifying Unit

Here, the printer 1 according to this embodiment is a line head printer in which multiple nozzles are simultaneously driven. Therefore, the printer 1 is required to generate the drive signal COM capable of driving the multiple piezoelectric elements PZT corresponding to the nozzles. At this time, it is also necessary to reduce degradation in quality of a produced material due to errors of DAC and the like. Thus, the printer 1 according to this embodiment with the configuration as shown in FIG. 8 is advantageous for such a problem.

Figure 8:
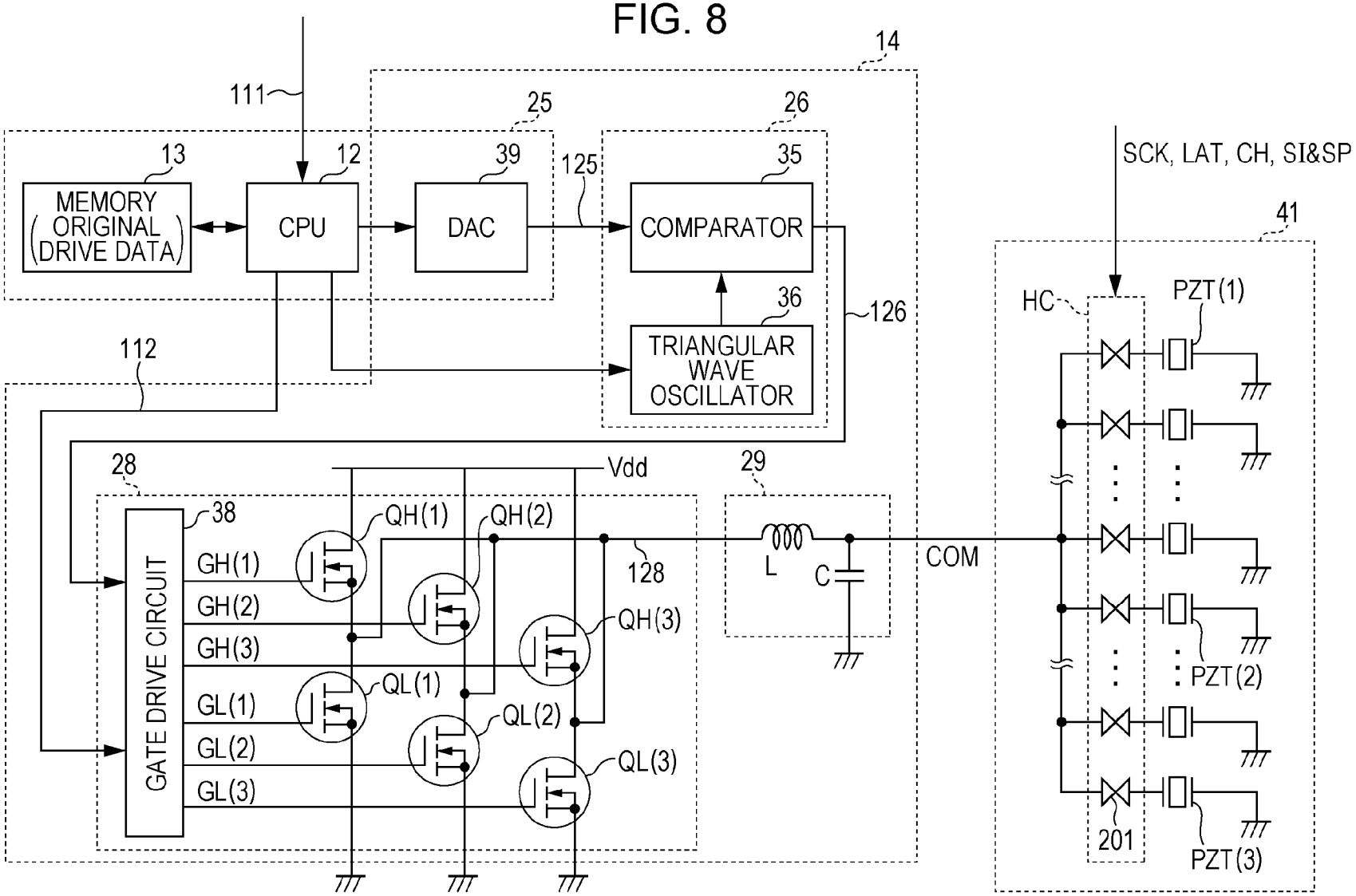
FIG. 8 is a detailed block diagram of a signal amplifying unit and the like according to a first embodiment.

FIG. 8 is a detailed block diagram of the signal amplifying unit 28 and the like in the printer 1 according to this embodiment. The head 41 includes multiple piezoelectric elements PZT corresponding to the nozzles. For example, the first piezoelectric element PZT(1), the second piezoelectric element PZT(2), and the third piezoelectric element PZT(3) shown in FIG. 8 correspond to the three piezoelectric elements in FIG. 1, which are a part of the entire piezoelectric elements PZT (several thousands of piezoelectric elements, for example). According to this embodiment, the drive signal COM can be applied to all the piezoelectric elements PZT including the first piezoelectric element PZT(1), the second piezoelectric element PZT(2), and the third piezoelectric element PZT(3). In FIG. 8, the cavities CA and the nozzles NZ are omitted.

As shown in FIG. 8, the head 41 includes the head control unit HC, and the head control unit HC includes the selection switch 201 for selecting whether to apply the voltage of the drive signal COM to each of the piezoelectric elements PZT. In FIG. 8, functional blocks (the shift register 211, for example; see FIG. 6) other than the selection switch 201 in the head control unit HC are omitted.

Here, the amplified modulation signal 128 generated by the signal amplifying unit 28 becomes the drive signal COM after passing through the signal conversion unit 29 which is implemented by a low pass filter as a combination of a coil L and a capacitor C, and it is necessary for the drive signal COM to be able to drive all the piezoelectric elements PZT (several thousands of piezoelectric elements, for example). That is, it is necessary to sufficiently amplify the amplified modulation signal 128 by the signal amplifying unit 28. Thus, the signal amplifying unit 28 according to this embodiment is configured to be able to sufficiently amplify the amplified modulation signal 128 by including the first to third signal amplifying units.

The first signal amplifying unit includes a switching element QH(1) on a high side, a switching element QL(1) on a low side, and a gate drive circuit 38. The second signal amplifying unit includes a switching element QH(2) on the high side, a switching element QL(2) on a low side, and the gate drive circuit 38. The third signal amplifying unit includes a switching element QH(3) on the high side, a switching element QL(3) on the low side, and the gate drive circuit 38. Although it is possible to employ a power MOSFET, for example, as the switching elements, the switching elements are not limited thereto.

The first to third signal amplifying units share the gate drive circuit 38 and respectively have the switching elements QH(i) and QL(i) {i=1, 2, 3} for substantially amplifying power. For this reason, although there is a limitation in current flowing through a pair of switching elements QH(i) and QL(i) {i=1, 2, 3}, it becomes possible to cause a higher current to flow as a whole by arranging pairs of the switching elements QH(i) and QL(i) {i=1, 2, 3} in parallel. Therefore, it is possible to sufficiently amplify the amplified modulation signal 128 and to increase the maximum amount of the liquid droplets which are discharged by the printer 1 at a time. That is, it becomes possible to eject the liquid from multiple nozzles included in the line head scheme liquid ejection type printing apparatus or the like.

Although the first signal amplifying unit outputs the first amplified modulation signal, the second signal amplifying unit outputs the second amplified modulation signal, and the third signal amplifying unit outputs the third amplified modulation signal, the first to third amplified modulation signals are electrically connected and configure a single amplified modulation signal 128 in the printer 1 according to this embodiment. Then, the amplified modulation signal 128 is converted into the drive signal COM by the signal conversion unit 29. In addition, although the signal amplifying unit 28 according to this embodiment includes the first to third signal amplifying units, the signal amplifying unit 28 may be configured not to include the third signal amplifying unit (that is, the signal amplifying unit 28 may include only the first and second signal amplifying units) or may be configured to include the first to j-th signal amplifying units (j is an integer which is equal to or greater than four).

In contrast, since the first to third signal amplifying units in the signal amplifying unit 28 according to this embodiment share the gate drive circuit 38, it is possible to suppress an influence of errors other than those of the switching elements. As shown in FIG. 8, gate input signals GH(1), GH(2), and GH(3) are provided to the switching elements QH(1), QH(2), and QH(3) on the high side, respectively, and the gate input signals GH(1), GH(2), and GH(3) are the same signal based on the modulation signal 126 in principle. In addition, the gate input signals GL(1), GL(2), and GL(3) are provided to the switching elements QL(1), QL(2), and QL(3) on the low side, respectively, and the gate input signals GL(1), GL(2), and GL(3) are the same signal based on the modulation signal 126 in principle. Accordingly, the signal amplifying unit 28 can suppress the influence of errors other than those of the switching elements.

In addition, the signal amplifying unit 28 can individually control the gate input signals GH(1), GH(2), GH(3), GL(1), GL(2), and GL(3) based on an amplification instruction signal 112 from the CPU 12 in order to suppress power consumption, and thus does not cause an error. For example, the gate drive circuit 38 uses the gate input signal GH(1) and GH(3) as predetermined pulse signals based on the modulation signal 126 and uses the gate input signal GH(2) as a low-level signal based on the amplification instruction signal 112. As can be understood from this example, the signal amplifying unit 28 does not generate a new pulse signal based on a signal different from the modulation signal 126 as a gate input signal. Therefore, the signal amplifying unit 28 according to this embodiment can suppress the influence of the errors other than those of the switching elements.

Here, there is an influence of an error cased in the DAC in a case where a plurality of modulation signals 126 based on a plurality of DACs are used in a circuit in a former stage than the gate drive circuit 38. In addition, there is a possibility in that the errors caused by the DACs and the errors caused by the first to third signal amplifying units (based on the switching elements, for example) increase in the multiplied manner due to the combination thereof. Therefore, it is necessary to generate a single modulation signal 126 by using a single DAC in the former stage than the signal amplifying unit 28. For this reason, the original drive signal generation unit 25 and the signal modulation unit 26 according to this embodiment are configured as shown in FIG. 8.

First, the original drive signal generation unit 25 includes the memory 13 which stores the original drive data of the original drive signal 125, which is configured by digital potential data and the like, the CPU 12 which reads the original drive data from the memory 13 based on the print data 111 from the interface unit 11, converts the original drive data into a voltage signal, holds a part of the voltage signal which corresponds to a predetermined sampling cycle, and provides instructions relating to a frequency, waveform, and waveform output timing of a triangular wave signal to a triangular wave oscillator 36 which will be described later, and the single DAC 39 which converts the voltage signal output from the CPU 12 into an analog signal and outputs the analog signal as the original drive signal 125.

The signal modulation unit 26 is a Pulse Width Modulation (PWM) circuit, includes the triangular wave oscillator 36 which outputs a triangular wave signal as a reference signal in accordance with the frequency, the waveform, and the waveform output timing instructed by the CPU 12 and a comparator 35 which compares the original drive signal 125 output from the DAC 39 and the triangular wave signal output from the triangular wave oscillator 36, and outputs the modulation signal 126 of a pulse duty which becomes on-duty when the original drive signal 125 is greater than the triangular wave signal. As described above, the original drive signal generation unit 25 and the signal modulation unit 26 according to this embodiment generates the single modulation signal 126 by using the single DAC. In addition, it is possible to use a known pulse modulation circuit such as a Pulse Density Modulation (PDM) circuit as the signal modulation unit 26 in another example.

As described above, the printer 1 according to this embodiment is provided with at least the first signal amplifying unit and the second signal amplifying unit as the signal amplifying unit 28 (the first to third signal amplifying units are included in this embodiment) and provide the signal based on the single modulation signal 126 to the plurality of signal amplifying units. Therefore, it is possible to apply the same drive signal COM with less errors to the respective nozzles in the printer 1 (line head printer) in which the multiple nozzles are driven at the same time, and to thereby improve the quality of the printed material by suppressing variations in discharge.

2. Second Embodiment

Figure 9:
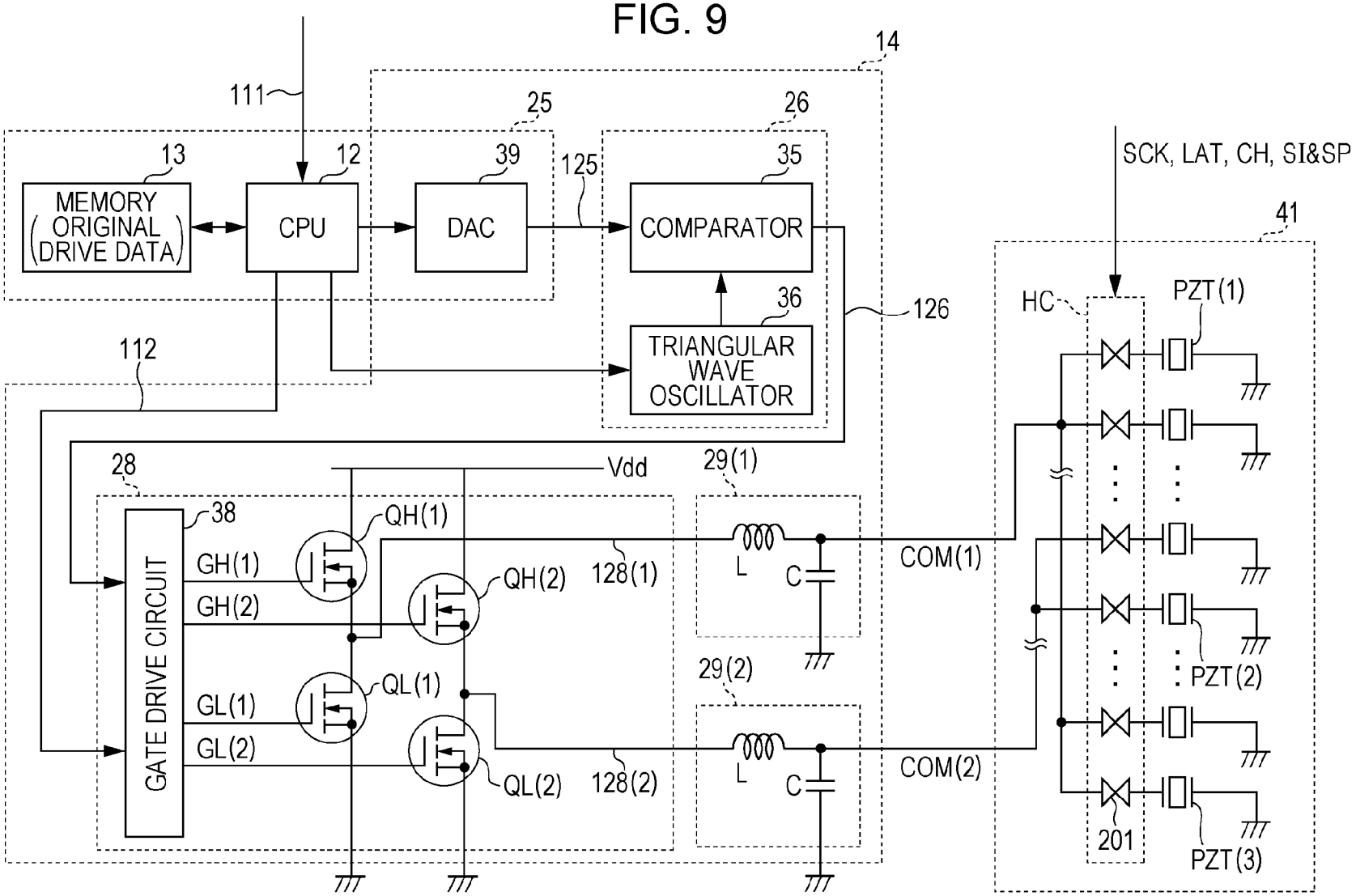
FIG. 9 is a detailed block diagram of a signal amplifying unit and the like according to a second embodiment.

Description will be given of an application of the liquid ejecting apparatus according to the invention to a liquid ejection type printing apparatus as the second embodiment. FIG. 9 is a detailed block diagram of the signal amplifying unit 28 and the like in the printer 1 according to the second embodiment. Since the overall configuration of the print system including the printer 1, the schematic cross-sectional view of the printer 1, the schematic top view, the drive signal, the control signals, and the like are the same as those in the first embodiment, the description thereof will be omitted. In addition, the same reference numerals are given to the same elements as those in FIGS. 1 to 8, and the descriptions thereof will be omitted.

The printer 1 according to the second embodiment is different from the printer 1 in the first embodiment (see FIG. 8) in that two signal conversion units 29, namely the first signal conversion unit 29(1) and the second signal conversion unit 29(2) are included, and that two drive signals, namely the first drive signal COM(1) and the second drive signal COM(2) are output from the first signal conversion unit 29(1) and the second signal conversion unit 29(2) and are respectively applied to different piezoelectric elements PZT.

In the example in FIG. 9, the first drive signal COM(1) is applied to the first piezoelectric element PZT(1), and the second drive signal COM(2) is applied to the second piezoelectric element PZT(2). Here, it is assumed that the first piezoelectric element PZT(1) is used for discharging the black ink from the first nozzle NZ(1) and the second piezoelectric element PZT(2) is used for discharging a color (cyan, magenta, or yellow, for example) ink from the second nozzle NZ(2), for example.

The CPU 12 causes the first signal amplifying unit (which is configured of the switching element QH(1), the switching element QL(1), and the gate drive circuit 38) and the second signal amplifying unit (which is configured by the switching element QH(2), the switching element QL(2), and the gate drive circuit 38) to amplify the first drive signal COM(1) and the second drive signal COM(2), respectively, in a color print mode. However, the CPU 12 performs power saving control without causing the second signal amplifying unit to amplify the unnecessary second drive signal COM(2) when the print mode of the printer 1 is a monochrome print mode. Here, the aforementioned color print mode corresponds to the first operation mode of the invention, the aforementioned monochrome print mode corresponds to the second operation mode of the invention, and the CPU 12 corresponds to the amplification control unit of the invention.

In addition, the CPU 12 can perform the power saving control in accordance with the print modes based on the amplification instruction signal 112 and the control signals (the clock signal SCK, the latch signal LAT, the channel signal CH, the drive pulse selection data SI and SP and the like) via the control signal generation unit 15 (not shown in FIG. 9). For example, the CPU 12 sets the gate input signals GH(2) and GL(2) at a low level in response to the amplification instruction signal 112. Then, the CPU 12 performs the power saving control by controlling the selection switch 201 based the control signal via the control signal generation unit 15 so as not to apply the second drive signal COM(2) to the second piezoelectric element PZT(2). In addition, the common modulation signal 126 is generated by using the single DAC 39 in the former stage than the signal amplifying unit 28 even in this embodiment, and it is possible to reduce degradation in quality of the produced material due to errors of the DAC and the like.

Here, the number of signal conversion units 29 which can be included in the printer 1 is not limited to two and may be three or more. In a case where black ink (black (K)), color ink (cyan (C), magenta (M), and yellow (Y)), light ink (light cyan (Lc) and light magenta (Lm)) are included as ink, a signal conversion unit 29 for generating a drive signal COM to be applied to piezoelectric elements PZT corresponding to nozzles NZ for discharging light ink may be additionally provided.

Furthermore, the printer 1 may include a plurality of signal conversion units 29 not only for performing the power saving control corresponding to the print modes but also for reducing burden (piezoelectric elements PZT) to be driven by a single drive signal COM and maintaining the printing quality. In order to reduce the burden, although it is also possible to calculate the number of piezoelectric elements PZT per a single drive signal COM and determine how many signal conversion units 29 are to be provided, it is preferable to perform allocation as described below in consideration of printing quality.

Description will be given on the assumption of the configuration as shown in FIG. 9. Which of the first drive signal COM(1) and the second drive signal COM(2) is to be applied to the piezoelectric element PZT may be determined depending on a position of the corresponding nozzle NZ (not shown in FIG. 9). For example, it is assumed that the first nozzle NZ(1) is provided at one side of the nozzle array, the third nozzle NZ(3) is provided at the other end of the nozzle array, and the second nozzle NZ(2) is provided at the center of the nozzle array. Here, a phenomenon called flight deflection may generally occur in the liquid ejection type printing apparatus. The flight deflection means a phenomenon where an ink droplet discharged from a nozzle does not fly along an ideal path and deviates from a landing position. In the case of the line head printer, in particular, so-called one-pass printing is performed, and therefore, a result of the printing is significantly degraded only by occurrence of a failure in ink ejection from a single nozzle among the multiple nozzles.

Usage rates of the nozzles positioned at the ends such as the first nozzle NZ(1) and the third nozzle NZ(3), in which the flight deflection easily occurs, are lower than that of the nozzle positioned at the center such as the second nozzle NZ(2). Therefore, it is possible to efficiently and equally allocate the burden by dividing the piezoelectric elements PZT into piezoelectric elements PZT to which the first drive signal COM(1) is applied and piezoelectric elements PZT to which the second drive signal COM(2) is applied depending on a recording rate (the ink amount per a unit area), for example. In addition, such allocation may be performed for each color of the ink, or may be performed for each type of the ink (black ink, the color ink, and the light ink, for example). Since the plurality of signal conversion units 29 are provided by performing the power saving control in accordance with the printing modes and in consideration of the flight deflection at this time, it is possible to further improve the quality of the printed material.

Here, the printer 1 according to this embodiment is provided with the signal amplifying units 28 in accordance with the number of signal conversion units 29. That is, the printer 1 shown as an example in FIG. 9 includes the first signal amplifying unit for providing the first amplified modulation signal 128(1) to the first signal conversion unit 29(1) and the second signal amplifying unit for providing the second amplified modulation signal 128(2) to the second signal conversion unit 29(2). By providing the signal amplifying units 28 and the signal conversion units 29 as pairs at this time, it is possible to offset a minus error in the signal amplifying unit 28 (an error in a direction in which the amplifying rate decreases) and a plus error (an error which acts in a direction opposite to that of the minus error) in the signal conversion unit 29, to apply the same drive signal COM to each nozzle NZ, and to thereby suppress variations in discharge and to improve the quality of the produced material. In addition, the number of signal conversion units 29 included in the printer 1 is not limited to two and may be three or more as described above. At this time, the printer 1 includes the same number of the signal amplifying units 28 as those of the signal conversion units 29.

As described above, the printer 1 according to this embodiment is provided with at least the first signal amplifying unit and the second signal amplifying unit as the signal amplifying units 28, and includes at least the first signal conversion unit 29(1) and the second signal conversion unit 29(2) for receiving the respective amplified modulation signals 128. The first signal conversion unit 29(1) and the second signal conversion unit 29(2) output the first drive signal COM(1) and the second drive signal COM(2), respectively, and the piezoelectric elements PZT to which these signals are applied are allocated as described above. For this reason, the printer 1 according to this embodiment can perform the power saving control corresponding to the print modes, for example, and can further improve the quality of the printed material by taking the flight deflection and the offset between the errors of the signal amplifying units 28 and the signal conversion units 29 into consideration.

3. Third Embodiment

Figure 10:
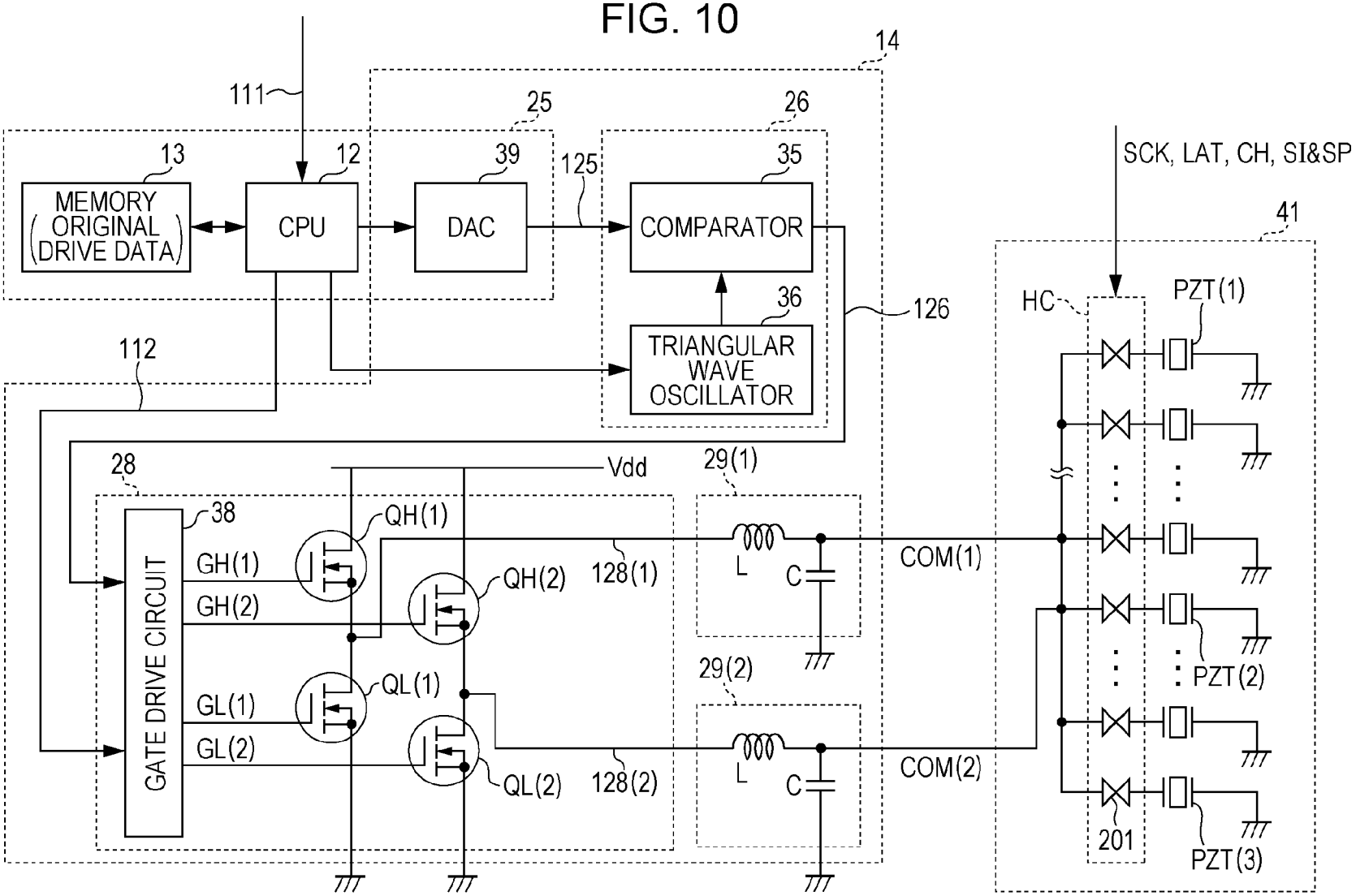
FIG. 10 is a detailed block diagram of a signal amplifying unit and the like according to a third embodiment.

Description will be given of an application of the liquid ejecting apparatus according to the invention to a liquid ejection type printing apparatus as the third embodiment. FIG. 10 is a detailed block diagram of the signal amplifying unit 28 and the like in the printer 1 according to the third embodiment. Since the overall configuration of the print system including the printer 1, the schematic cross-sectional view of the printer 1, the schematic top view, the drive signal, the control signals, and the like are the same as those in the first and second embodiments, the description thereof will be omitted. In addition, the same reference numerals are given to the same elements as those in FIGS. 1 to 9, and the description thereof will be omitted.

The printer 1 according to the third embodiment is different from the printer 1 in the second embodiment (see FIG. 9) in that the first drive signal COM(1) and the second drive signal COM(2) are electrically connected and can be applied to all the piezoelectric elements PZT including the first piezoelectric element PZT(1), the second piezoelectric element PZT (2), and the third piezoelectric element PTZ(3).

In the printer 1 according to the third embodiment, it is possible to improve the power saving property by the CPU 12 using the second signal amplifying unit only when necessary. That is, when the second drive signal COM(2) is not necessary, the CPU 12 uses the first signal amplifying unit and drives the piezoelectric element PZT only by the first drive signal COM(1). Here, in the case where the second drive signal COM(2) is necessary the number of nozzles NZ to be driven is equal to or greater than a predetermined threshold value, for example. The predetermined threshold value may be set based on experiment data or simulation data for verifying whether or not a produced material with sufficient quality can be obtained when only the first drive signal COM(1) is used. Alternately, the threshold value may be set based on a ratio of the switching elements used for generating the first drive signal COM(1) with respect to the switching elements included in the signal amplifying unit 28. In the example in FIG. 9, a half of the switching elements QH(i) and QL(i) {i=1, 2} is used for generating the first drive signal COM(1). Accordingly, ½ of the total number of the nozzles NZ may be regarded as the predetermined threshold value.

Figure 11:
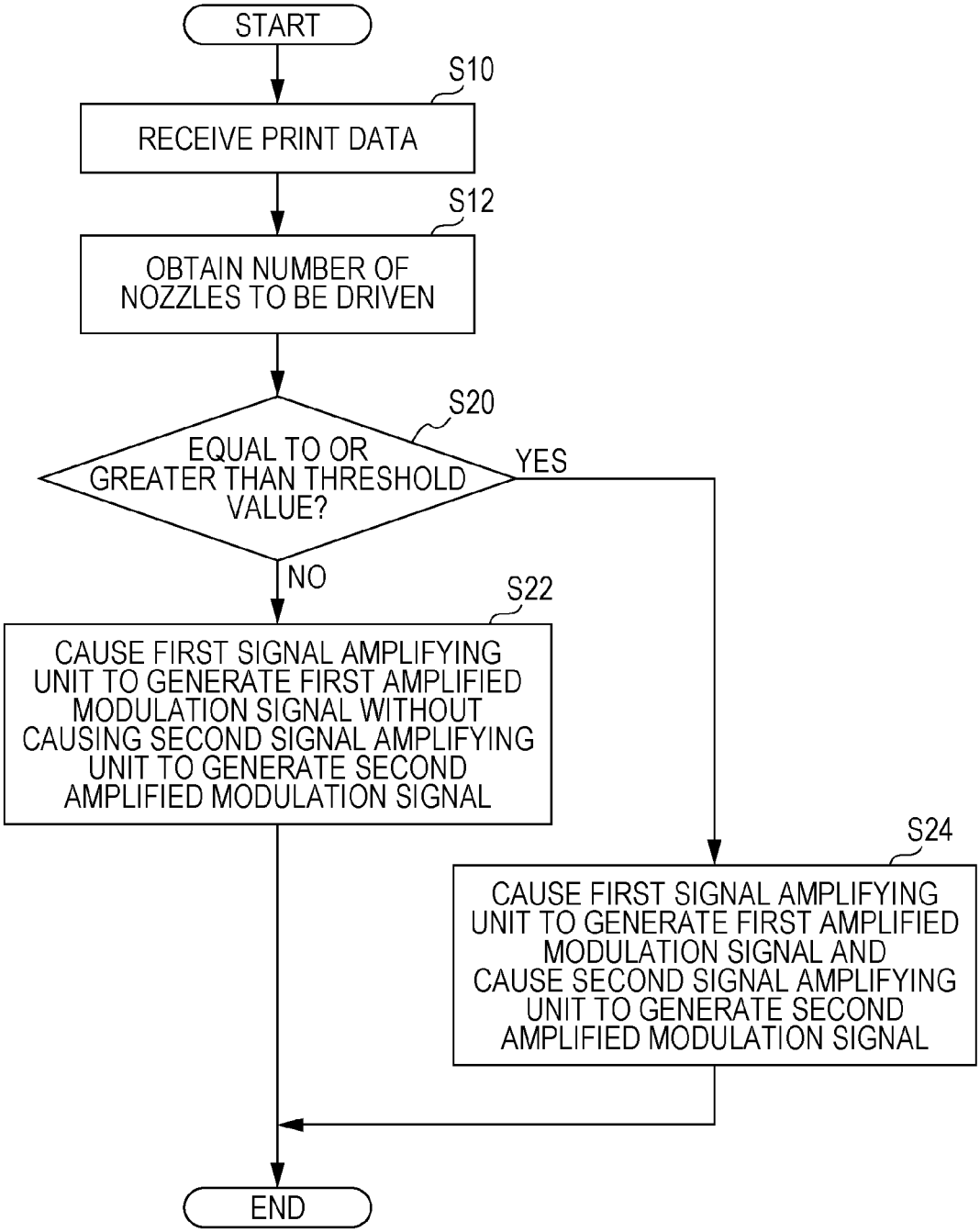
FIG. 11 is a flowchart illustrating processing by a CPU according to the third embodiment.

FIG. 11 is a flowchart illustrating the determination processing by the CPU 12 at this time. As described above, the CPU 12 functions as a kind of computer for controlling the printer 1. The CPU 12 may execute the series of processes in FIG. 11 in accordance with a program read from the memory 13 or the storage medium 113.

The CPU 12 receives the print data 111 from the interface unit 11 (S10). The print data 111 includes image data and data for designating a print mode, for example. The CPU 12 obtains information on the number of nozzles to be driven for printing the designated image (hereinafter, referred to as a number of nozzles to be driven) based on the print data 111 (S12). Here, the CPU 12 may obtain the number of nozzles to be driven by computation, or in a case where the print data 111 includes the information on the number of nozzles to be driven, the CPU 12 may only extract the information.

The CPU 12 determines whether or not the number of nozzles to be driven is equal to or greater than the aforementioned threshold value (the value corresponding to ½ of the total number of nozzles, for example) (S20). If the number of nozzles to be driven is equal to or greater than the predetermined value (S20Y), then the CPU 12 causes the first signal amplifying unit to generate the first amplified modulation signal 128(1) and causes the second signal amplifying unit to generate the second amplified modulation signal 128(2) (S24). Since it is possible to apply the drive signal COM with sufficient driving ability, which is a combination of the first drive signal COM(1) and the second drive signal COM(2), to the piezoelectric elements PZT even in a case where all the nozzles are used, for example, the quality of the produced material is not degraded.

In contrast, if the number of nozzles to be driven is less than the predetermined threshold value (S20N), the CPU 12 causes the first signal amplifying unit to generate the first amplified modulation signal 128(1) without causing the second signal amplifying unit to generate the second signal amplified modulation signal 128(2) (S22). At this time, the quality of the produced material is not degraded even if only the first drive signal COM(1) is applied, and it is possible to improve the power saving property by not using the second amplifying unit.

As described above, the printer 1 according to this embodiment causes the second signal amplifying unit to generate the second amplified modulation signal 128(2) only when the number of the nozzles to be driven is equal to or greater than the predetermined threshold value, in accordance with the aforementioned control method which can be implemented by a program or the like. For this reason, the second signal amplifying unit is not used when not necessary, and therefore, it is possible to improve the power saving property.

According to this embodiment, output of the plurality of signal amplifying units may be electrically connected to generate the first amplified modulation signal 128(1) or the second amplified modulation signal 128(2). For example, the third signal amplifying unit may be provided to electrically connect an output of the first signal amplifying unit and an output of the third signal amplifying unit and uses the synthesized signal as the first amplified modulation signal 128(1). At this time, the aforementioned predetermined threshold value may be adjusted in accordance with a ratio of the driving abilities of the first amplified modulation signal 128(1) and the second amplified modulation signal 128(2).

In addition, this embodiment is not limited to the line head scheme liquid discharging apparatus, and the same effect can be achieved by a liquid ejection type printing apparatus with a requirement of driving multiple piezoelectric elements at the same time.

4. Others

The invention includes substantially the same configurations (the same configurations with the same functions, methods, and results or configurations for the same purposes and effects) as the configurations described in the above embodiments and the application examples. In addition, the invention includes configurations in which non-essential parts in the configurations described in the embodiments and the like are replaced. Moreover, the invention includes configurations which can bring the same advantages as those of the configurations described in the embodiments and the like or configurations which can achieve the same purposes. Furthermore, the invention includes configurations which are achieved by adding known techniques to the configurations described in the embodiments and the like.

What is claimed is:

1. A liquid discharging apparatus comprising:

an original drive signal generation unit that generates an original drive signal;

a signal modulation unit that modulates the original drive signal to generate a modulation signal;

a first signal amplifying unit that amplifies the modulation signal to generate a first amplified modulation signal;

a second signal amplifying unit that amplifies the modulation signal to generate a second amplified modulation signal;

an amplification control unit that controls operations of the first signal amplifying unit and the second signal amplifying unit;

a signal conversion unit that converts the first amplified modulation signal and the second amplified modulation signal into a drive signal, wherein the signal conversion unit includes a first signal conversion unit and a second signal conversion unit, the drive signal includes a first drive signal and a second drive signal, the first signal conversion unit converts the first amplified modulation signal into the first drive signal, and the second signal conversion unit converts the second amplified modulation signal into the second drive signal;

a first piezoelectric element that is deformed by the first drive signal;

a first cavity that expands or contracts in accordance with the deformation of the first piezoelectric element;

a first nozzle that communicates with the first cavity and discharges liquid in accordance with an increase or a decrease in pressure in the first cavity;

a second piezoelectric element that is deformed by the second drive signal;

a second cavity that expands or contracts in accordance with the deformation of the second piezoelectric element;

a second nozzle that communicates with the second cavity and discharges the liquid in accordance with an increase or a decrease in pressure in the second cavity;

a third piezoelectric element that is deformed by the first drive signal;

a third cavity that expands or contracts in accordance with the deformation of the third piezoelectric element; and a third nozzle that communicates with the third cavity and discharges the liquid in accordance with an increase or a decrease in pressure in the third cavity, wherein the first nozzle is provided at one end of a nozzle array, the third nozzle is provided at the other end of the nozzle array, and the second nozzle is provided at a center of the nozzle array between the first nozzle and the second nozzle.

2. The liquid discharging apparatus according to claim 1, wherein the amplification control unit causes the first signal amplifying unit to generate the first amplified modulation signal and causes the second signal amplifying unit to generate the second amplified modulation signal in a first operation mode in which liquid is discharged from the first nozzle and the second nozzle, and causes the first signal amplifying unit to generate the first amplified modulation signal without causing the second signal amplifying unit to generate the second amplified modulation signal in a second operation mode in which the liquid is ejected from the first nozzle and is not ejected from the second nozzle.

3. The liquid discharging apparatus according to claim 1, wherein the amplification control unit causes the first signal amplifying unit to generate the first amplified modulation signal without causing the second signal amplifying unit to generate the second amplified modulation signal when the nozzles, a number of which is less than a predetermined threshold value, are driven, and causes the first signal amplifying unit to generate the first amplified modulation signal and causes the second signal amplifying unit to generate the second amplified modulation signal when the nozzles, a number of which is equal to or greater than the threshold value, are driven.

* * * * *